US011506368B1

(12) United States Patent
Chen

(10) Patent No.: US 11,506,368 B1
(45) Date of Patent: Nov. 22, 2022

(54) UNIVERSAL CLIP

(71) Applicant: Bill Y Chen, Rancho Palos Verdes, CA (US)

(72) Inventor: Bill Y Chen, Rancho Palos Verdes, CA (US)

( * ) Notice: Subject to any disclaimer, the term of this patent is extended or adjusted under 35 U.S.C. 154(b) by 0 days.

(21) Appl. No.: 17/737,867

(22) Filed: May 5, 2022

(51) Int. Cl.

| | |
|---|---|
| ***F21V 21/088*** | (2006.01) |
| ***F21L 4/02*** | (2006.01) |
| ***A43B 23/24*** | (2006.01) |
| *F21Y 115/10* | (2016.01) |

(52) U.S. Cl.
CPC ..... *F21V 21/0885* (2013.01); *A43B 23/24* (2013.01); *F21L 4/02* (2013.01); *F21Y 2115/10* (2016.08)

(58) Field of Classification Search
CPC ..... F21V 21/0885; A43B 23/24; F21L 4/02; F21Y 2115/10
See application file for complete search history.

(56) References Cited

U.S. PATENT DOCUMENTS

| | | | | |
|---|---|---|---|---|
| 5,857,469 | A * | 1/1999 | Sowell | A45D 8/24 132/278 |
| 6,302,554 | B1 * | 10/2001 | Holce | F21V 33/0004 362/104 |
| 8,240,868 | B1 * | 8/2012 | Sims | A44C 15/0015 362/108 |
| D836,838 | S * | 12/2018 | Sze | D28/43 |
| 10,258,133 | B2 * | 4/2019 | Beck | A45D 8/26 |
| 2004/0007243 | A1 * | 1/2004 | Paterson | A45D 8/26 132/278 |
| 2009/0109660 | A1 * | 4/2009 | Dutcher | A45D 8/28 362/103 |

* cited by examiner

*Primary Examiner* — Evan P Dzierzynski
(74) *Attorney, Agent, or Firm* — Ying-Ting Chen

(57) ABSTRACT

A universal clip includes a base housing including a plurality of light-emitting diodes (LED) lights; a fastening assembly affixed on the base housing; a decorative element attached with the base housing; and a sensor electrically connected with the LED lights to activate lighting effects produced by the LED lights; wherein the fastening assembly includes a locking cavity and an elongated locking arm selectively engaged within the locking cavity to perform a locked position and an unlocked position.

19 Claims, 5 Drawing Sheets

UNIVERSAL CLIP

FIELD OF THE DISCLOSURE

The present disclosure relates to a universal clip, and more particularly to the universal clip, which is suitable for cooperating with various types of footwear. It is particularly suitable for not only providing lighting effects but also able to provide aesthetic effects based on the users' needs.

BACKGROUND OF THE DISCLOSURE

Generally, the shoes "with lighting" characteristically help people safely move around inside their homes or in closed environments, even in the dark.

It is frequent, in fact, that in the home and if there are children, toys and other objects can be found scattered on the floor, and a light source on shoes or slippers directed to light up the way, would allow who is wearing them not only to move around easily but also to avoid the risk of stumbling or falling due to obstacles.

In addition, a decorative article is well known to combine with the lighting system to make various types of designs such as patterns, letters, or various trademarks, etc., with metal and plastics and be connected on the footwear. These decorative articles are beautiful in color, and the stronger decorative effect is arranged by day. And, they can be luminous at night because of their lighting effects.

However, the current shoes have lights and flashing devices, which have also been built-in into the shoe's body. Lights and flashing devices can provide dynamic visual effects and can more easily attract attention. In particular, varying light on shoes when worn at night serves as visual ornaments and safety devices. Further, to connect the lights and flashing devices on the current footwear, the footwear needs to have unique designs for cooperating with the lights and flashing devices. The most common and popular designs are clog shoes with a plurality of pre-designed holes (e.g., Crocs) for engaging with the lights and flashing devices. Such lights and flashing devices are only suitable for being used for particular types of footwear styles. In other words, neither of the products mentioned above allows the removal of the lights and flashing devices to be used on any other footwear. If the users want to enjoy shoes that light up each step, current products are limited only to particular options and designs.

All referenced patents, applications and literatures are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply. The disclosed embodiments may seek to satisfy one or more of the above-mentioned desires. Although the present embodiments may obviate one or more of the above-mentioned desires, it should be understood that some aspects of the embodiments might not necessarily obviate them.

BRIEF SUMMARY OF THE DISCLOSURE

In a general implementation, a universal clip comprises a base housing comprising a plurality of light-emitting diodes (LED) lights; a fastening assembly attached on the base housing; a decorative element attached with the base housing; and a sensor electrically connected with the LED lights to activate lighting effects produced by the LED lights;

wherein the fastening assembly comprises a locking cavity and an elongated locking arm selectively engaged within the locking cavity to perform a locked position and an unlocked position.

In another aspect combinable with the general implementation, the universal clip may further comprise a circuit board electrically connected to the LED lights and a battery to deliver electrical power produced from the battery to the LED lights.

Further, it is contemplated that the sensor is located on a bottom side of the battery to receive a triggering force produced by an external motion.

In the alternative, the fastening assembly comprises a supporting base affixed on the base housing and a retaining end downwardly extended from the elongated locking arm.

It is still further contemplated that the fastening assembly further comprises an upright arm upwardly extended from the supporting base and a connecting portion connected between the upright arm and the elongated locking arm, wherein, in the locked position, the connecting portion is bent with the retaining end being received inside the locking cavity.

In one embodiment, the fastening assembly further comprises an upright arm upwardly extended from a supporting base and a connecting portion connected between the upright arm and the elongated locking arm, wherein a receiving cavity is formed between the supporting base, the upright arm, the connection portion, and the elongated locking arm.

Among the many possible compounds contemplated for condensation, the connecting portion is bent towards the supporting base in the locked position until a male retaining tab is received inside the locking cavity.

Among the many possible implementations of the universal clip, the supporting base is upwardly extended towards the retaining end of the elongated locking arm to form the locking cavity.

In another aspect combinable with the general implementation, the retaining end is received inside the locking cavity in the locked position.

In another aspect combinable with the general implementation, the retaining end is located above the locking cavity in the unlocked position.

In another aspect combinable with the general implementation, the locking cavity comprises a locking slot formed inside the locking cavity.

In another aspect combinable with the general implementation, in the locked position, the retaining end is received inside the locking cavity, wherein the retaining end comprises a male retaining tab to be received inside a locking slot formed inside the locking cavity, wherein the male retaining tab is inclinedly formed on a V-shaped retaining body of the retaining end.

In another aspect combinable with the general implementation, the retaining end comprises a male retaining tab released from a locking slot formed inside the locking cavity in the unlocked position.

In another aspect combinable with the general implementation, the retaining end comprises a V-shaped retaining body and a male retaining tab inclinedly formed on the retaining body, wherein the V-shaped retaining body and the male retaining tab are flexible materials bendable to be received inside the locking cavity.

In another aspect combinable with the general implementation, the retaining end comprises an activating lever outwardly extended from a V-shaped retaining body of the retaining end, wherein the activating lever is protruded from the locking cavity to receive an external force for releasing the V-shaped retaining body from the locking cavity.

In another aspect combinable with the general implementation, the fastening assembly further comprises a female retaining tab upwardly and integrally extended from the locking cavity and a male retaining tab downwardly and integrally extended from a retaining end.

In another aspect combinable with the general implementation, the female retaining tab is biased against the male retaining tab in the unlocked position.

In another aspect combinable with the general implementation, in the locked position, the male retaining tab is received inside the locking cavity.

In another aspect combinable with the general implementation, the fastening assembly further comprises an upright arm upwardly extended from a supporting base and a connecting portion connected between the upright arm and the elongated locking arm, wherein a receiving cavity is formed between the supporting base, the upright arm, the connection portion, and the elongated locking arm.

In another aspect combinable with the general implementation, the connecting portion is bent towards the supporting base in the locked position until the male retaining tab is received inside the locking cavity.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation.

Conversely, various features that are described in the context of a single implementation can also be implemented in multiple implementations separately or in any suitable subcombination. Moreover, although features may be described above and below as acting in certain combinations and even initially claimed as such, one or more features from a claimed combination can in some cases be excised from the combination, and the claimed combination may be directed to a subcombination or variation of a subcombination.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiment in any manner.

DETAILED DESCRIPTION OF THE EMBODIMENTS

The different aspects of the various embodiments can now be better understood by turning to the following detailed description of the embodiments, which are presented as illustrated examples of the embodiments defined in the claims. It is expressly understood that the embodiments as defined by the claims may be broader than the illustrated embodiments described below.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

It shall be understood that the term "means," as used herein, shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

Unless defined otherwise, all technical and position terms used herein have the same meaning as commonly understood by one of ordinary skill in the art to which the invention pertains. Although many methods and materials similar, modified, or equivalent to those described herein can be used in the practice of the present invention without undue experimentation, the preferred materials and methods are described herein. In describing and claiming the present invention, the following terminology will be used in accordance with the definitions set out below.

As used herein, the term "downward" refers to a direction opposite of a direction defined by the term "upward." For example, the term "downwardly extended" refers to a direction towards the supporting base (or the base housing), and the term "upwardly extended" refers to a direction away from the supporting base (or the base housing). Also, the term "outward" refers to a direction opposite of a direction defined by the term "inward." For example, the term "outwardly extended" refers to a direction away from the connecting portion, and the term "inwardly extended" refers to a direction towards the connecting portion.

Figure 1:
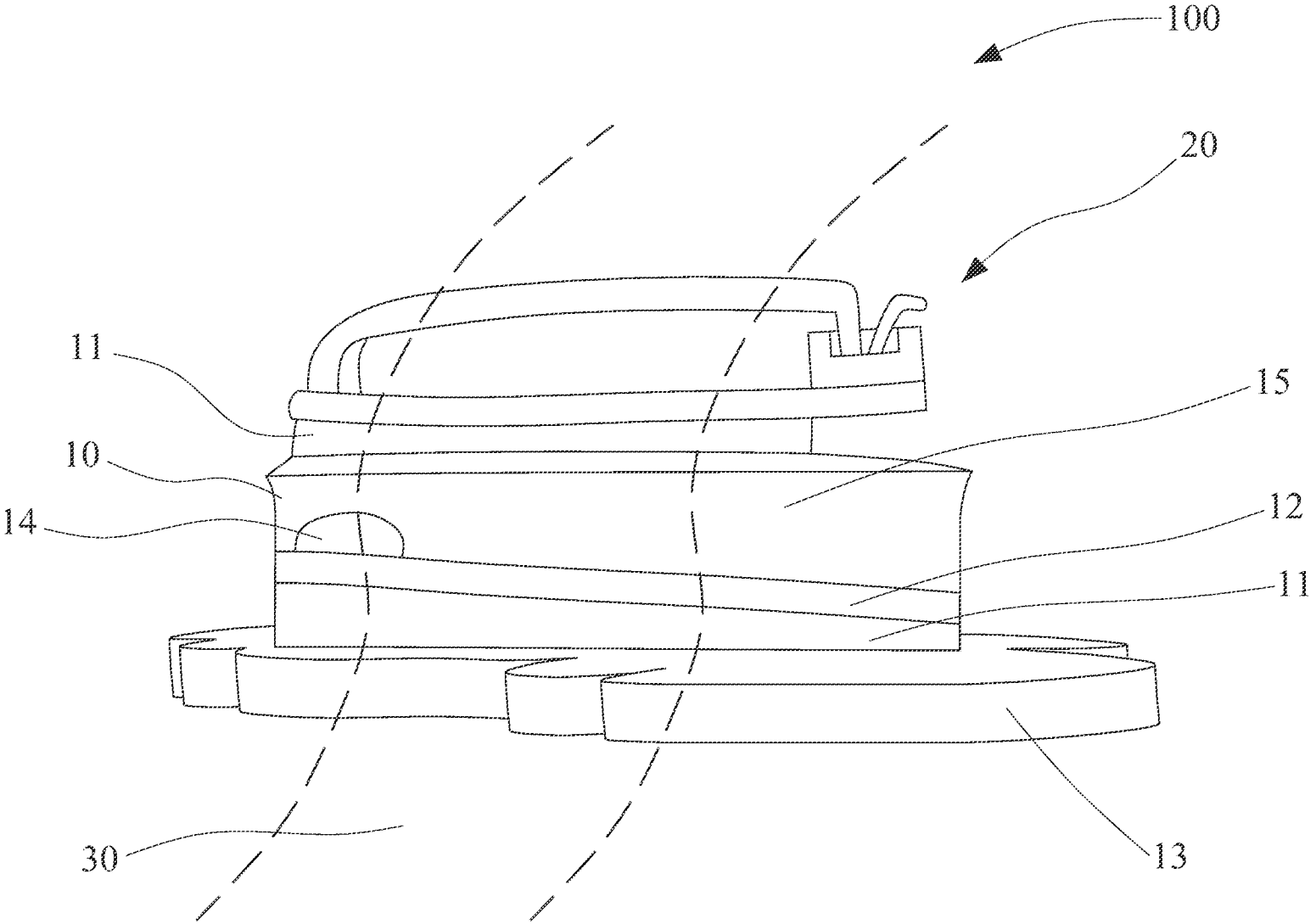
FIG. 1 is a perspective view of a universal clip, showing a fastening assembly in a locked position, according to an aspect of the embodiment.

FIG. 1 generally depicts a universal clip 100, showing a fastening assembly 20 in a locked position, according to an aspect of an embodiment.

Referring to FIG. 1, the universal clip 100 comprises a base housing 10, the fastening assembly 20 affixed on a top side of the base housing 10, and a decorative element 13 affixed on a bottom side of the base housing 10; wherein the top side of the base housing 10 may be opposite of the bottom side of the base housing 10. In one embodiment, the base housing 10 may be located between the fastening assembly 20 and the decorative element 13. For example, the base housing 10 may be sandwiched between the fastening assembly 20 and the decorative element 13.

In one embodiment, the universal clip 100 may further comprise a plurality of LED lights 11 and a circuit board 12, wherein the LED lights 11 and the circuit board 12 may be arranged between the fastening assembly 20 and the decorative element 13. For example, the LED lights 11 and the circuit board 12 may be deposed inside the base housing 10.

In another embodiment, the universal clip 100 further comprises a sensor 14 electrically connected with the LED lights 11 to activate lighting effects produced by the LED lights 11 and a battery 15, wherein the battery 15 is located inside the base housing 10 to provide electrical power to the LED lights 11, wherein the sensor 14 may detect a triggering force produced by an external motion. It should be noted that the external force may be applied on the universal clip 100 to generate angular momentum. In such a manner, the triggering force may be generated to activate the sensor 14 to generate an activating signal. Then, the activating signal generated by the sensor 14 may be delivered to the circuit board 12 to activate the electrical power being transmitted from the battery 15 to the LED lights 11. Accordingly, for example, the sensor 14 may be a trigger rod with a surrounding coil surrounding the trigger rod, and in such a manner, at the same time, the external motion is applied to the trigger rod, the trigger rod may flex to be in contact with the surrounding coil. Continuously, the activating signal may be generated by the sensor 14, and the activating signal may be delivered to the circuit board 12 to activate the electrical power being transmitted from the battery 15 to the LED lights 11.

It should be understood that the above-described sensor 14 is exemplary and any other sensor 14 can be adopted in various embodiments of this disclosure.

Figure 2:
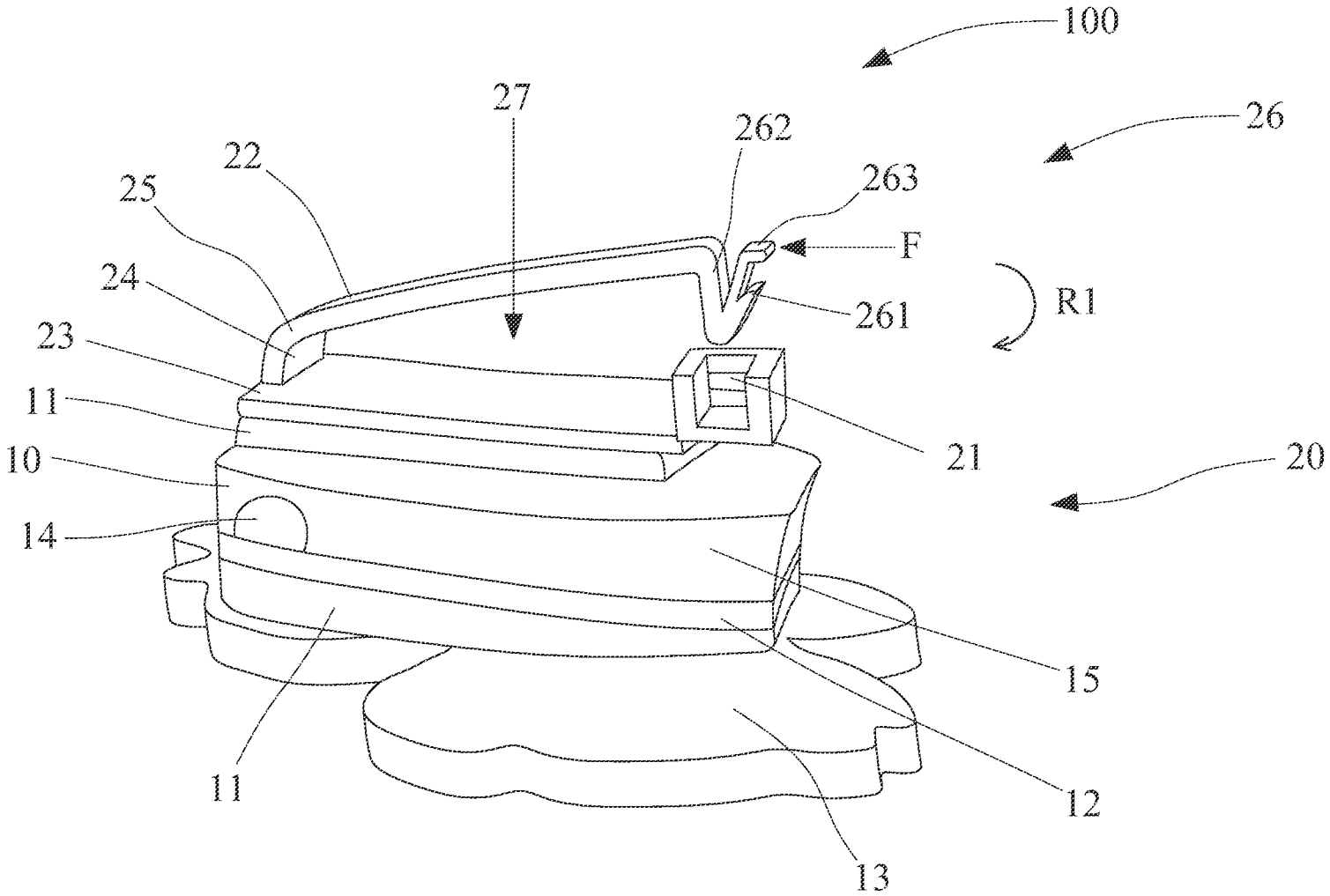
FIG. 2 is a perspective view of the universal clip, showing the fastening assembly in an unlocked position, according to an aspect of the embodiment.

FIG. 2 generally depicts the universal clip 100, showing the fastening assembly 20 in the unlocked position, according to an aspect of the invention.

Referring now to the detail of FIG. 2, the fastening assembly 20 comprises a locking cavity 21 and an elongated locking arm 22 selectively engaged within the locking cavity 21 to perform a locked position.

In one embodiment, the fastening assembly 20 may further comprise a supporting base 23 affixed on the top side of the base housing 10 and a retaining end 26 downwardly extended from the elongated locking arm 22, wherein the retaining end 26 is selectively received inside the locking cavity 21.

In another embodiment, in the unlocked position, the retaining end 26 is located above the locking cavity 21. For example, the retaining end 26 may be released from the locking cavity 21, and in such a manner, the elongated locking arm 22 may be inclined and angled with respect to the supporting base 23.

The retaining end 26 of FIG. 2 may further comprise a V-shaped retaining body 262 downwardly extended from the elongated locking arm 22 and a male retaining tab 261 inclinedly formed on the V-shaped retaining body 262. In one embodiment, to perform the locked position, an external force F may be applied on the retaining end 26, and in such a way, the retaining end 26 may be compressed to be received inside the locking cavity 21.

In still another embodiment, the fastening assembly 20 may further comprise an upright arm 24 upwardly extended from the supporting base 23 and a connecting portion 25 connected between the upright arm 24 and the elongated locking arm 23, wherein the connecting portion 25 may be an arc-shape and made of flexible materials.

The retaining end 26 of FIG. 2 also optionally includes an activating lever 263 outwardly extended from the V-shaped retaining body 262 of the retaining end 26, wherein the external force F may be applied on the activating lever 263, and in such a way, the V-shaped retaining body 262 may be compressed to be received inside the locking cavity 21.

Figure 3:
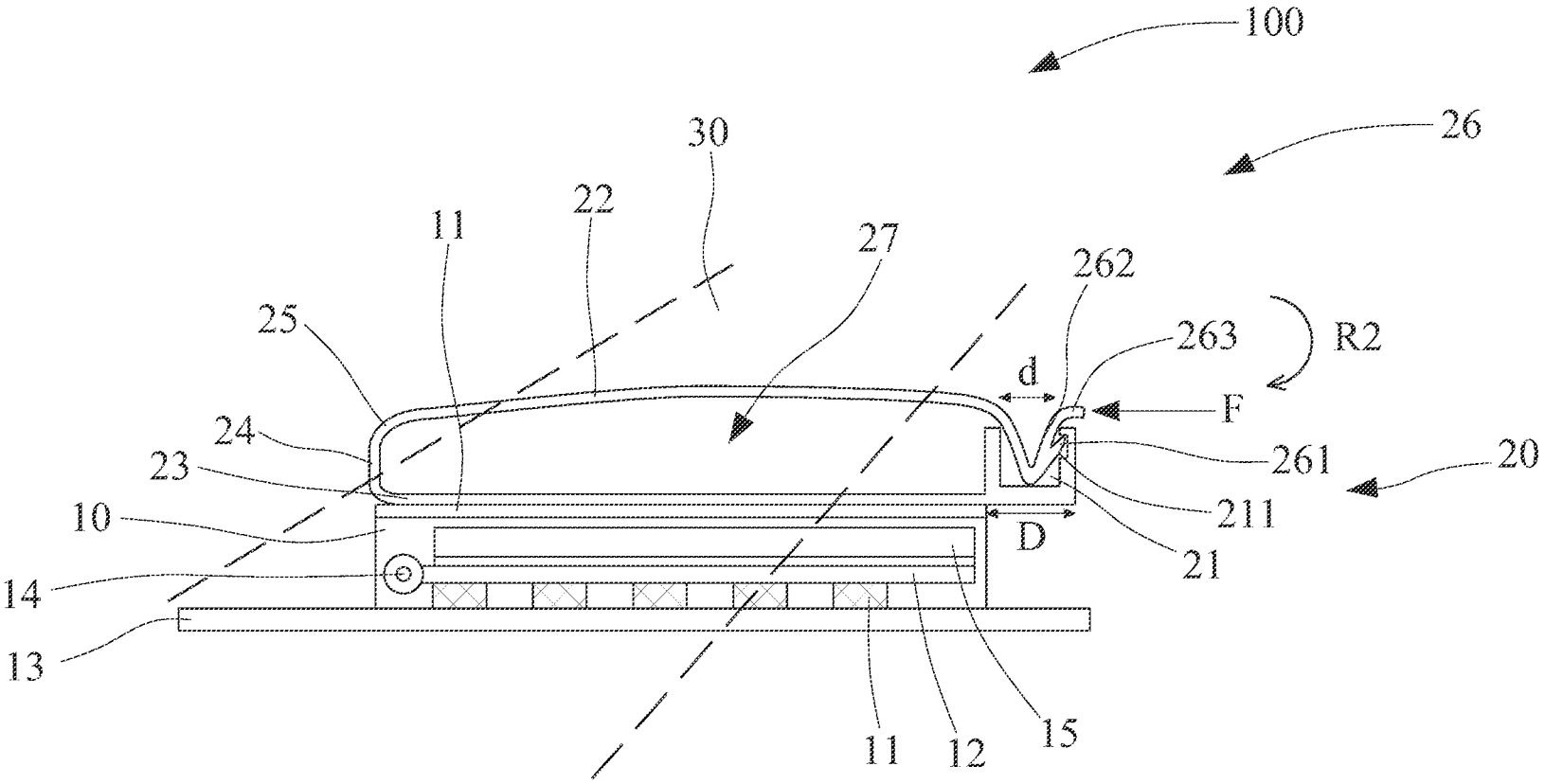
FIG. 3 is a side view of the universal clip, showing the fastening assembly in the locked position, according to an aspect of the embodiment.

FIG. 3 generally depicts the universal clip 100, showing the fastening assembly 20 in the locked position, according to an aspect of the invention.

In one embodiment, in the locked position, the retaining end 26 may be received inside the locking cavity 21, and in such a way, the connecting portion 25 may be bent towards the supporting base 23 until the V-shaped retaining body 262 is received inside the locking cavity 21. As shown further details in FIG. 3, while the V-shaped retaining body 262 is received inside the locking cavity 21, the activating lever 263 may be protruded from the locking cavity 21 to receive the external force F for releasing the V-shaped retaining body 262 away from the locking cavity 21.

In another embodiment, the fastening assembly 20 may further comprise a receiving cavity 27 formed between the upright arm 24 upwardly extended from the supporting base 23, the connecting portion 25 connected between the upright arm 24 and the elongated locking arm 22, the supporting base 23, and the elongated locking arm 22. It should be noted that, in some embodiments, an object 30 may be passed through the receiving cavity 27 and be locked inside the receiving cavity 27.

Accordingly, in one embodiment, the object 30 may be shoelaces or a surface of the footwear. It should be understood that the above-described object 30 is exemplary and any other objects 30 can be adopted in various embodiments of this disclosure.

As shown further in FIG. 3, the supporting base 23 may be upwardly extended towards the retaining end 26 of the elongated locking arm 22 to form the locking cavity 21, wherein, in the locked position, the retaining end 26, including the V-shaped retaining body 262 and the male retaining tab 261, may be compressed and downwardly moved towards the locking cavity 21 until the retaining end 26 is received inside the locking cavity 21. For example, the retaining end 26, including the V-shaped retaining body 262 and the male retaining tab 261, is downwardly moved along a direction R1 until the retaining end 26 is received inside the locking cavity 21. For another example, the retaining end 26, including the V-shaped retaining body 262 and the male retaining tab 261, may clockwise rotate along the direction R1 until the V-shaped retaining body 262 is received inside the locking cavity 21 and the male retaining tab 261 is received inside a locking slot 211.

In one embodiment, the locking cavity 21 may comprise the locking slot 211 formed inside the locking cavity 21, wherein the locking slot 211 may integrally extend from an interior surface of the locking cavity 21. In the locked position, the external force F may be applied to the activating lever 263 to compress the V-shaped retaining body 262 and the male retaining tab 261 until the V-shaped retaining body 262 is received inside the locking cavity 21 and the male retaining tab 261 is received inside the locking slot 211. In other words, in the locked position, in one embodiment, once the external force F is released, the V-shaped retaining body 262 and the male retaining tab 261 may reinstate until the V-shaped retaining body 262 is biased against the locking cavity 21 and the male retaining tab 261 is biased against the locking slot 211. The male retaining tab 261 of FIG. 3 may be received inside the locking slot 211 to secure the retaining end 26 inside the locking cavity 21.

Referring now to the details of FIG. 2 and FIG. 3, in the unlocked position, the external force F may be applied to the activating lever 263 to compress the V-shaped retaining body 262 and the male retaining tab 261, and in such a way, the V-shaped retaining body 262 and the male retaining tab 261 may release from the locking cavity 21 and locking slot 211 respectively. It should be noted that in the unlocked position, the connecting portion 25 may reinstate and move away from the supporting base 23 until the V-shaped retaining body 262 and the male retaining tab 261 are released from the locking cavity 21 and the locking slot 211, respectively. For example, the V-shaped retaining body 262 and the male retaining tab 261 may move away from the supporting base 23 along a direction R2 until the V-shaped retaining body 262 and the male retaining tab 261 are released from the locking cavity 21. For another example, the V-shaped retaining body 262 and the male retaining tab 261 are counterclockwise rotated with the connecting portion 25 being reinstated until the V-shaped retaining body 262 and the male retaining tab 261 are released from the locking cavity 21.

In still another embodiment, the locking cavity 21 may comprise a width D defined between a right side wall of the locking cavity 21 and a left side wall of the locking cavity 21, wherein the V-shaped retaining body 262 may further comprise a width d defined by a width of an opening formed by the V-shaped retaining body 262. In order to perform the locked position, the external force F may be applied on the activating lever 263 to compress the V-shaped retaining body 262, and then the width "d" of the opening formed by the V-shaped retaining body 262 may be decreased, and in such a manner, the V-shaped retaining body 262 may be inserted into the locking cavity 21. It should be noted that, in one embodiment, in the locked position, the width D defined between the right side wall of the locking cavity 21 and the left side wall of the locking cavity 21 is larger than the width "d" of the opening defined by the V-shaped retaining body 262.

Accordingly, in the locked position, as shown in FIG. 3, the V-shaped retaining body 262 may be biased against the locking cavity 21 to secure the fastening assembly 20 in the locked position.

Figure 4:
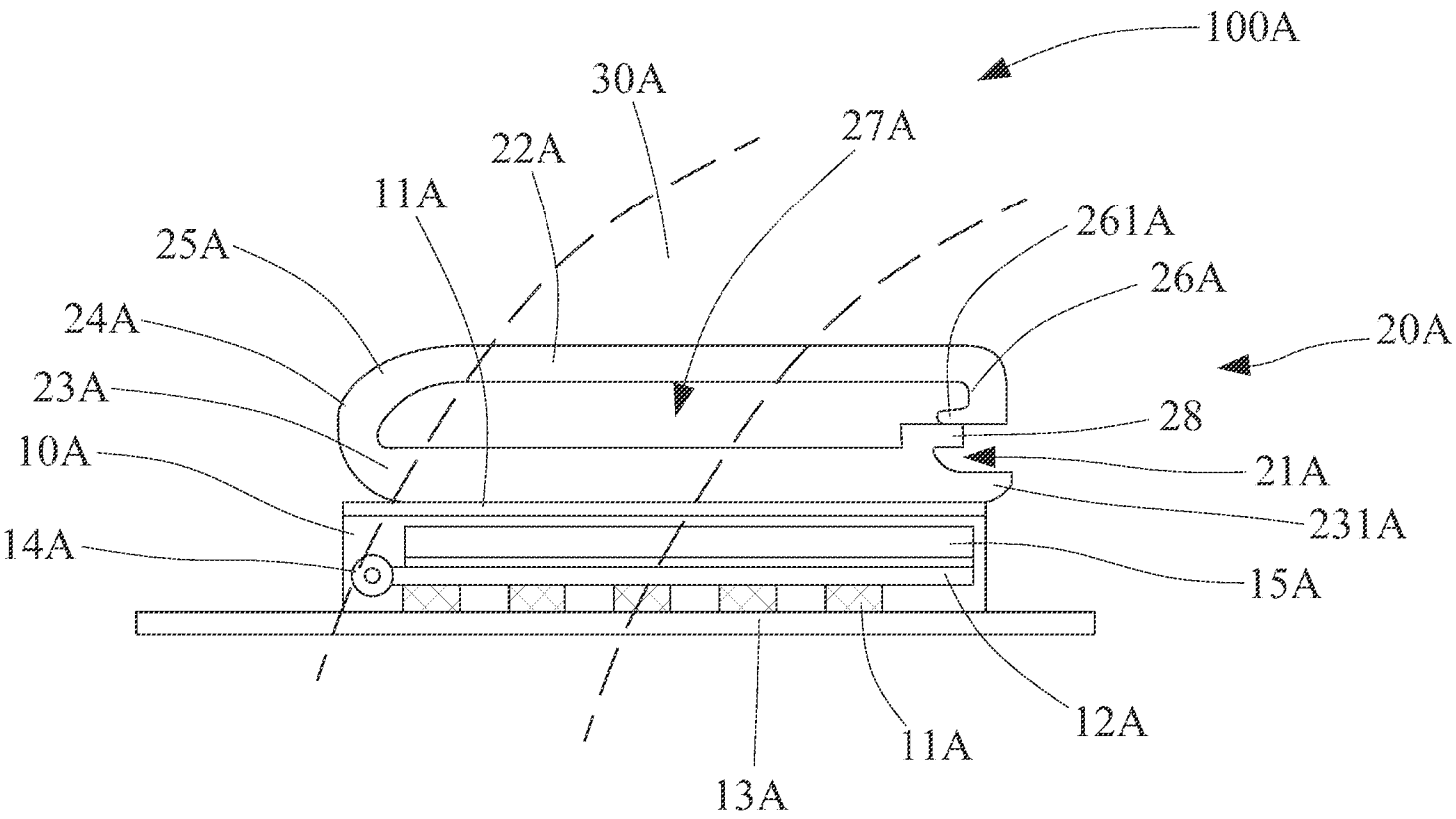
FIG. 4 is a side view of a universal clip, showing a fastening assembly in an unlocked position, according to an aspect of another embodiment.
Figure 5:
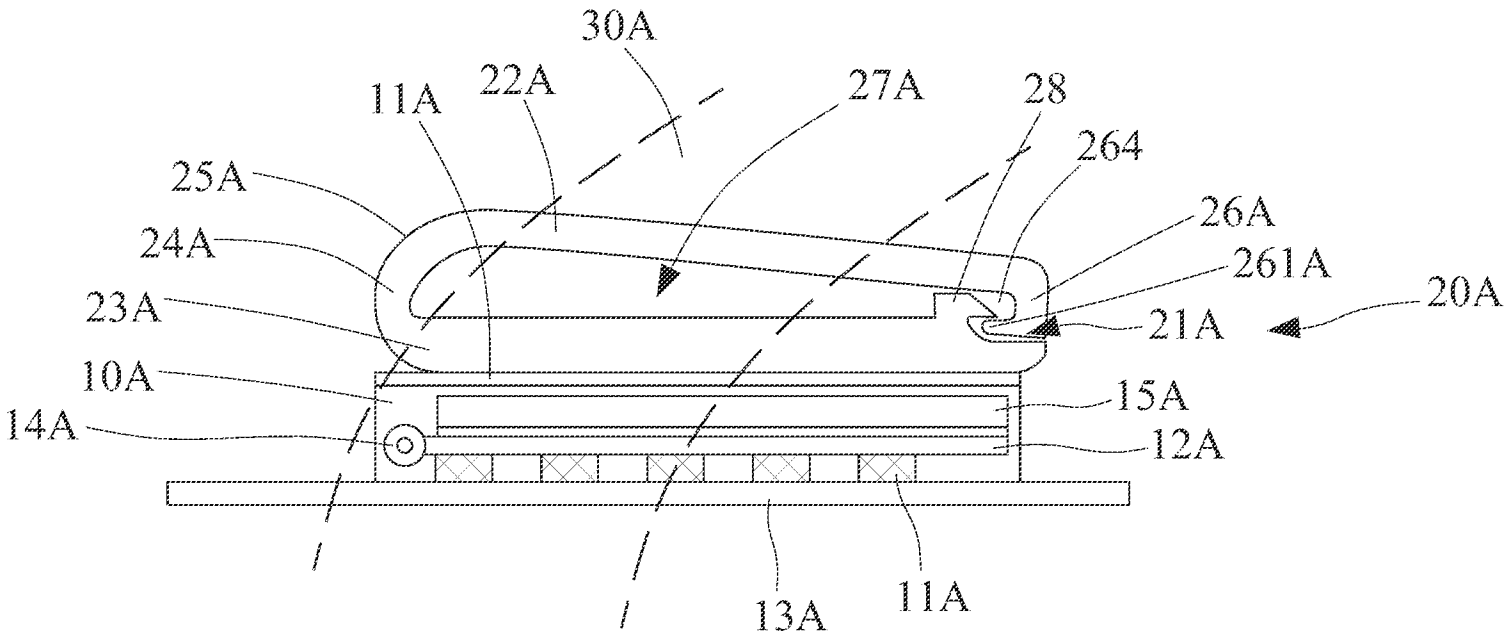
FIG. 5 is a side view of the universal clip, showing the fastening assembly in a locked position, according to an aspect of another embodiment.

FIG. 4 and FIG. 5 generally depict a universal clip 100A according to an aspect of another embodiment of the invention.

Referring to FIG. 4 of the drawings, the structure of the universal clip 100A as shown in FIG. 4 and FIG. 5 is similar to the structure of the universal clip 100, as shown in FIGS. 1-3, except the structure of the fastening assembly 20A, as shown in FIG. 4 and FIG. 5.

Referring to FIG. 4, the universal clip 100A comprises the base housing 10A, the fastening assembly 20A affixed on a top side of the base housing 10A, and the decorative element 13A attached on a bottom side of the base housing 10A, wherein the top side of the base housing 10A may be opposite of the bottom side of the base housing 10A. In one embodiment, the base housing 10A may be located between the fastening assembly 20A and the decorative element 13A. For example, the base housing 10A may be sandwiched between the fastening assembly 20A and the decorative element 13A.

In one embodiment, the universal clip 100A may further comprise the plurality of LED lights 11A and the circuit board 12A, wherein the LED lights 11A and the circuit board 12A may be arranged between the fastening assembly 20A and the decorative element 13A. For example, the LED lights 11A and the circuit board 12A may be deposed inside the base housing 10A.

In another embodiment, the universal clip 100A may further comprise the sensor 14A electrically connected with the LED lights 11A to activate lighting effects produced by the LED lights 11A, and the battery 15A which is located inside the base housing 10A to provide electrical power to the LED lights 11A, wherein the sensor 14A may detect angular momentum produced by an external motion. For example, the sensor 14A may be a trigger rod with a surrounding coil surrounding the trigger rod, and in such a manner, while the external motion is applied on the trigger rod, the trigger rod may flex to be in contact with the surrounding coil, and then an activating signal may be generated by the sensor 14A. The activating signal may be delivered to the circuit board 12A to activate the electrical power being transmitted from the battery 15A to the LED lights 11A.

It should be understood that the above-described sensor 14A is exemplary and any other sensor 14A can be adopted in various embodiments of this disclosure.

The fastening assembly 20A of FIG. 4 and FIG. 5 may further comprise the locking cavity 21A and the elongated locking arm 22A selectively engaged within the locking cavity 21A to perform the locked position.

Accordingly, in one embodiment, the fastening assembly 20A may further comprise the supporting base 23A affixed on the top side of the base housing 10A and the retaining end 26A downwardly extended from the elongated locking arm 22A, wherein the retaining end 26A may be selectively received inside the locking cavity 21A.

Turning now to FIG. 4 and FIG. 5, in one embodiment, the fastening assembly 20A may further comprise the receiving cavity 27A formed between the upright arm 24A upwardly extended from the supporting base 23A, the connecting portion 25A connected between the upright arm 24A and the elongated locking arm 22A, the supporting base 23A, and the elongated locking arm 22A. It should be noted that, in some embodiments, the object 30A may be passed through the receiving cavity 27A and be locked inside the receiving cavity 27A.

Continuing with FIG. 4 and FIG. 5, the fastening assembly 20A may further comprise the male retaining tab 261A inwardly extended from the retaining end 26A towards the upright arm 24A and a female retaining tab 28 upwardly and integrally extended from the locking cavity 21A. For example, the retaining end 26A may be downwardly and integrally extended from the elongated locking arm 22A.

As shown in further details in FIG. 4., the universal clip 100A may be in the unlocked position where the female retaining tab 28 may be biased against the male retaining tab 261A, and in such a manner, the female retaining tab 28 may locate above the locking cavity 21A.

With specific reference to FIG. 4, the supporting base 23A may be outwardly extended away from the upright arm 24A to form the locking cavity 21A, wherein a top side of the locking cavity 21A may integrally extend to form the female retaining tab 28, and the supporting base 23A may be formed on a bottom side of the locking cavity 21A, and it should be noted that the top side of the locking cavity 21A is opposite of the bottom side of the locking cavity 21A.

In one embodiment, the supporting base 23A may further comprise a free supporting end 231A outwardly extended away from the upright arm 24A, wherein the locking cavity 21A is defined between the female retaining tab 28 and the free supporting end 231A.

Accordingly, operations of the universal clip 100A in the locked position are straightforward. In order to perform the locked position, a portion of the retaining end 26A and the male retaining tab 261A, may be compressed and downwardly moved towards the locking cavity 21A until the male retaining tab 261A is received inside the locking cavity 21A. At the same time, the connecting portion 25A may be bent towards the supporting base 23A until the male retaining tab 261A is received inside the locking cavity 21A.

It should be noted that, in some embodiments, the retaining end 26A may be downwardly extended from the elongated locking arm 22A, and the male retaining tab 261A may be inwardly and integrally extended from the retaining end 26A towards the upright arm 24A, and in such a way, a securing cavity 264 may be formed by the elongated locking arm 22A, the retaining end 26A, and the male retaining tab 261A.

In one embodiment, while the male retaining tab 261A is deposed inside the locking cavity 21A, the female retaining tab 28 may be received inside the securing cavity 264 to secure the universal clip 100A in the locked position.

According to the above embodiments of FIG. 1 to FIG. 5, the fastening assembly 20A, 20 may be made of suitable materials to have flexibility, such materials include natural and synthetic polymers, various flexible metals and metal alloys, naturally occurring materials, sol-gel materials, and all reasonable combinations thereof.

Many alterations and modifications may be made by those having ordinary skill in the art without departing from the spirit and scope of the disclosed embodiments. Therefore, it must be understood that the illustrated embodiments have been set forth only for the purposes of example and that it should not be taken as limiting the embodiments as defined by the following claims. For example, notwithstanding the fact that the elements of a claim are set forth below in a certain combination, it must be expressly understood that the embodiment includes other combinations of fewer, more, or different elements, which are disclosed herein even when not initially claimed in such combinations.

Thus, specific embodiments and applications of the universal clip have been disclosed. It should be apparent, however, to those skilled in the art that many more modifications besides those already described are possible without departing from the disclosed concepts herein. The disclosed embodiments, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalents within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted, and also what essentially incorporates the essential idea of the embodiments. In addition, where the specification and claims refer to at least one of something selected from the group consisting of A, B, C . . . and N, the text should be interpreted as requiring at least one element from the group which includes N, not A plus N, or B plus N, etc.

The words used in this specification to describe the various embodiments are to be understood not only in the sense of their commonly defined meanings, but to include by special definition in this specification structure, material, or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims therefore include not only the combination of elements that are literally set forth but all equivalent structures, material, or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

What is claimed is:

1. A universal clip, comprising:

a base housing comprising a plurality of light-emitting diodes (LED) lights;

a fastening assembly attached on the base housing;

a decorative element attached with the base housing; and a sensor electrically connected with the LED lights to activate lighting effects produced by the LED lights; wherein the fastening assembly comprises a locking cavity and an elongated locking arm selectively engaged within the locking cavity to perform a locked position and an unlocked position; wherein the fastening assembly comprises a supporting base affixed on the base housing and a retaining end downwardly extended from the elongated locking arm towards the supporting base.

2. The universal clip of claim 1, further comprising a circuit board electrically connected to the LED lights and a battery, wherein electrical power produced by the battery is delivered to the LED lights by the circuit board.

3. The universal clip of claim 1, wherein the sensor is located on a bottom side of a battery to receive a triggering force produced by an external motion.

4. The universal clip of claim 1, wherein the fastening assembly further comprises an upright arm upwardly extended from the supporting base and a connecting portion connected between the upright arm and the elongated locking arm, wherein, in the locked position, the connecting portion is bent with the retaining end being received inside the locking cavity.

5. The universal clip of claim 1, wherein the fastening assembly further comprises an upright arm upwardly extended from a supporting base and a connecting portion connected between the upright arm and the elongated locking arm, wherein a receiving cavity is formed between the supporting base, the upright arm, the connection portion, and the elongated locking arm.

6. The universal clip of claim 1, wherein, in the locked position, the elongated locking arm is clockwise rotated with the connecting portion is bending until the retaining end is received inside the locking cavity.

7. The universal clip of claim 1, wherein the supporting base is upwardly extended towards the retaining end of the elongated locking arm to form the locking cavity.

8. The universal clip of claim 1, wherein, in the locked position, the retaining end is received inside the locking cavity.

9. The universal clip of claim 1, wherein, in the unlocked position, the retaining end is released from and located above the locking cavity.

10. The universal clip of claim 1, wherein the locking cavity comprises a locking slot formed inside the locking cavity, wherein the locking slot is integrally extended from an interior surface of the locking cavity.

11. The universal clip of claim 1, wherein, in the locked position, the retaining end comprises a male retaining tab to be received inside a locking slot formed inside the locking cavity, wherein the male retaining tab is inclinedly formed on a V-shaped retaining body of the retaining end.

12. The universal clip of claim 1, wherein, in the unlocked position, the retaining end comprises a male retaining tab which is released from a locking slot formed inside the locking cavity.

13. The universal clip of claim 1, wherein the retaining end comprises a V-shaped retaining body and a male retaining tab inclinedly formed on the V-shaped retaining body, wherein the V-shaped retaining body and the male retaining tab are flexible materials that are bendable to be received inside the locking cavity.

14. The universal clip of claim 1, wherein, in the locked position, the retaining end comprises an activating lever outwardly extended from a V-shaped retaining body of the retaining end, wherein the activating lever is protruded from the locking cavity to receive an external force for releasing the V-shaped retaining body from the locking cavity.

15. The universal clip of claim 1, wherein the fastening assembly further comprises a female retaining tab upwardly and integrally extended from the locking cavity and a male retaining tab inwardly and integrally extended from a retaining end which is downwardly and integrally extended from the elongated locking arm.

16. The universal clip of claim 15, wherein, in the unlocked position, the female retaining tab is biased against the male retaining tab.

17. The universal clip of claim 15, wherein, in the locked position, the male retaining tab is received inside the locking cavity, and the female retaining tab is received inside a securing cavity formed by a retaining end, the male retaining tab, and the elongated locking arm.

18. The universal clip of claim 15, wherein the fastening assembly further comprises an upright arm upwardly extended from a supporting base attached on the base housing, a connecting portion connected between the upright arm and the elongated locking arm, and a retaining end downwardly extended from the elongated locking arm, wherein a receiving cavity is formed between the supporting base, the upright arm, the connection portion, the retaining end, and the elongated locking arm.

19. The universal clip of claim 18, wherein, in the locked position, the elongated locking arm is clockwise rotated with the connecting portion being bent until the male retaining tab is received inside the locking cavity.

* * * * *